United States Patent [19]

Knight

[11] Patent Number: 4,972,691

[45] Date of Patent: Nov. 27, 1990

[54] WINDOW OR DOOR LATCH

[76] Inventor: Robert W. Knight, 7 Hall Rise, Haxby, York, England, YO3 8LP

[21] Appl. No.: 312,710

[22] PCT Filed: Jul. 28, 1987

[86] PCT No.: PCT/GB87/00536

§ 371 Date: Jan. 25, 1989

§ 102(e) Date: Jan. 25, 1989

[87] PCT Pub. No.: WO88/00998

PCT Pub. Date: Feb. 11, 1988

[30] Foreign Application Priority Data

Jul. 29, 1986 [GB] United Kingdom ..... 8618489

[51] Int. Cl.[5] ..... E05B 65/00

[52] U.S. Cl. ..... 70/89; 70/213

[58] Field of Search ..... 70/77–84, 70/89, 90, 207–211, 213, 214, 218–220, 416

[56] References Cited

U.S. PATENT DOCUMENTS

| | | | |
|---|---|---|---|
| 1,434,947 | 11/1922 | Freysinger | 70/417 X |
| 3,667,263 | 6/1972 | Rogers | 70/89 |
| 3,796,072 | 3/1974 | Weeks | 70/89 |
| 3,903,717 | 9/1975 | Rifkin | 70/89 |
| 4,050,724 | 9/1977 | Nakanishi | 70/89 X |
| 4,491,354 | 1/1985 | Williams | 70/417 X |
| 4,569,213 | 2/1986 | Scelba | 70/84 |
| 4,763,497 | 8/1988 | Nakai | 70/213 X |

FOREIGN PATENT DOCUMENTS

| | | | |
|---|---|---|---|
| 58917 | 5/1939 | Denmark | 70/214 |
| 759232 | 1/1934 | France | 70/213 |
| 835366 | 12/1938 | France | 70/213 |
| 168065 | 3/1934 | Switzerland | 70/213 |
| 452295 | 8/1936 | United Kingdom | 70/89 |
| 452597 | 8/1936 | United Kingdom | 70/89 |
| 2037868 | 7/1980 | United Kingdom | 70/213 |
| 2147046 | 5/1985 | United Kingdom | 70/89 |

*Primary Examiner*—Robert L. Wolfe
*Assistant Examiner*—Suzanne L. Dino
*Attorney, Agent, or Firm*—Michael B. Lasky

[57] ABSTRACT

A pivoting handle type winder or door latch actuating handle (1, 2) and a pivoting stay type of window retaining latch (19, 20) for mounting on a movable frame of an openable door or window, and which is co-operable with a corresponding keeper on or in a surrounding fixed frame in order to latch the movable frame to the fixed frame. The latch comprises a latching element (23) which is movable into latching engagement with the keeper when the movable frame is in a closed position with respect to the surrounding fixed frame, and a locking mechanism is provided to lock the engagement of the latching element with the keeper. An elongate arm (1, 2; 19, 20) is coupled with the latching element, and at least two combinations wheels (9) are mounted on the elongate arm and arranged to control the operation of the locking mechanism so that the latch element can only be released from locking engagement with the keeper when a respective predetermined correct combination is set on each of the combination wheels. The arrangement of the combination wheels (9) on the elongate actuator handle arm (1, 2) and on the stay arm (19, 20) provides a secure mounting of the combination wheels, which cannot readily be interfered with by an intruder, and yet which provide an unobtrusive visual appearance, combined with easy manipulation by finger or thumb of an authorized user.

9 Claims, 4 Drawing Sheets

WINDOW OR DOOR LATCH

This invention relates to a latch for mounting on a movable frame of an openable door or window and which is co-operable with a corresponding keeper on a surrounding fixed frame in order to latch the movable frame to the fixed frame.

Window latches of the type commonly used in private houses normally have a pivoting handle which is mounted on the movable frame of an opening window, and which cooperates with a keeper mounted on a fixed part of the surrounding window frame. Often, in conjunction with the pivoting handle, there is provided a retainer stay which is pivotally mounted on the movable window frame and which can be engaged with one or more upstanding spigots or projections on the fixed frame in order to retain the window in any desired open position, or in a closed position in which case it supplements the latching in the closed position which is already provided by the pivoting handle.

It is known to provide so-called "window locks" in order to provide an additional safety lock for a closed window against unauthorised attempts at entry via the window. These window locks include locks which are separate from, and which do not cooperate with existing window handles or stays, these locks having a key-operated locking element which is mounted on the movable frame and which engages with a keeper e.g. a slit or hole, in the surrounding fixed frame. There are also key-operated window locks which cooperate with existing window stays so as to lock the stays in any predetermined position.

However, both of these types of window locks suffer from the disadvantage of requiring the use of a special key, and this ought to be kept in a safe place, but it is often the case that the key is left near to the window lock, e.g. on a window sill, ready for use, and therefore is readily available to an intruder after breaking the window glass from the outside.

It is therefore an object of the invention to provide a locking mechanism which can cooperate with a releasable latch of a door or window and which does not require the use of a special key.

Also, with the pivoting handle type of window latch, there is an elongate actuator arm for manual operation in order to operate and release a latching element (usually a plate or tongue from its keeper (a slot in the fixed frame), whereas with the pivoting retainer stay type window latch there is an elongate arm for manual operation in order to operate or release a latching element in the form of an apertured plate with respect to its keeper on the fixed frame, which comprises an upstanding spigot or projection.

Similarly, a door handle type latch has an elongate actuator arm for manual operation in order to operate and release a latching element, usually in the form of a spring loaded cam, with respect to its keeper in the form of a slot formed in the fixed frame.

Therefore, for the purposes of the present specification, the pivoting handle type latch for a window or door, and the pivoting stay type of window latch, will be referred to hereinafter as "a latch of the type specified", which will comprise an elongate arm, and a latching element engagable with a fixed keeper.

According to the invention there is provided a latch of the type specified for mounting on a movable frame of an openable door or window and which is co-operable with a corresponding keeper on or in a surrounding fixed frame in order to latch the movable frame to the fixed frame, in which the latch comprises a latching element which is movable into latching engagement with the keeper when the movable frame is in a closed position with respect to the surrounding fixed frame, a locking mechanism operable to lock the engagement of the latching element with the keeper, an elongate arm coupled with the latching element, and at least two combination wheels mounted on the elongate arm and arranged to control the operation of the locking mechanism so that the latching element can only be released from locking engagement with the keeper when a respective predetermined correct combination is set on each of the combination wheels.

Two main embodiments of latch of the type specified according to the invention will now be described in detail, by way of example only, with reference to the accompanying drawings, in which.

There will now follow detailed description of the construction and advantages of the preferred embodiment of the invention, in comparison with existing designs of window fastenings. (these comparisons are also applicable to the door lock version shown in FIG. 6.).

GENERAL ADVANTAGES (COMPARED WITH EXISTING FASTENINGS.)

Pivoting Handle

Existing

The pivoting handle is normally fitted to side hung windows on the side opposite to the hinges, and acts as a low grade of lock when the window is closed. Some models allow the window to be held in a slightly open position, but do not provide any method of locking when in this position. There are many methods of locking the previously mentioned pivoting handles. However they fall into either a semi-permanent fastening i.e. woodscrews holding the handle to the window frame, or they make use of a locking device using a key of one sort or another.

Proposed Embodiment

The proposed new lock has a combination system whereby a set of thumbwheels are required to be set to a predetermined number before the pivoting lock can be opened.

The new lock does not require a key to be used to open or close it, so that no key can be mislayed, or left in the lock to be used if the adjacent glass or wood panels are broken. (It is usual for a thief to still open a window after breaking its glass, rather than risk being cut climbing over broken glass). General Advantages (cont.)

Retaining Stay

Existing

The retaining stay is usually fitted to the bottom of either side-hung or top-hung windows. This type of stay acts as a low level of lock when the window is closed, and as a method of holding the window in various positions when the window is open. There are many methods of locking the previously mentioned existing retaining stays. However, they also have the same drawbacks as mentioned previously.

Proposed Embodiment

The proposed new lock has a combination system whereby a set of thumbwheels are required to be set to a predetermined number before the retaining stay lock can be opened. The window may be opened to any one of a set number of positions and the retaining stay lock re-locked, so that, for example, an upstairs fanlight window may be left slightly open to provide ventilation, but at the same time still be securely locked.

The new lock does not require a key to be used to open or close it, so that no key can be mislayed, or left in the lock to be used if the window pane is broken.

METHOD OF OPERATION

Pivoting Handle

As mentioned previously this form of the embodiment is subdivided into three versions i.e. a/U.K. b/European and c/Door lock.

Figure 1:
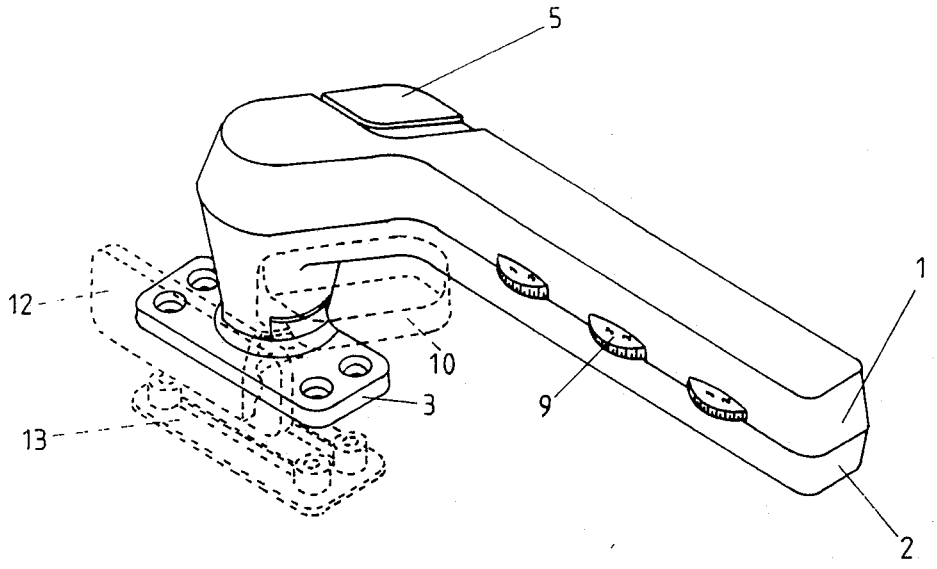
FIGS. 1 to 6 are illustrations of detailed component parts of a first embodiment of latch according to the invention in the form of a pivoting handle. (this form of the embodiment is sub-divided into three versions, namely, a/U.K. b/European and C/Door lock).

All three versions of this lock have a common handle section as shown in FIG. 1, the differences between the versions arises from the final arrangement of the pivoting section.

Figure 2:
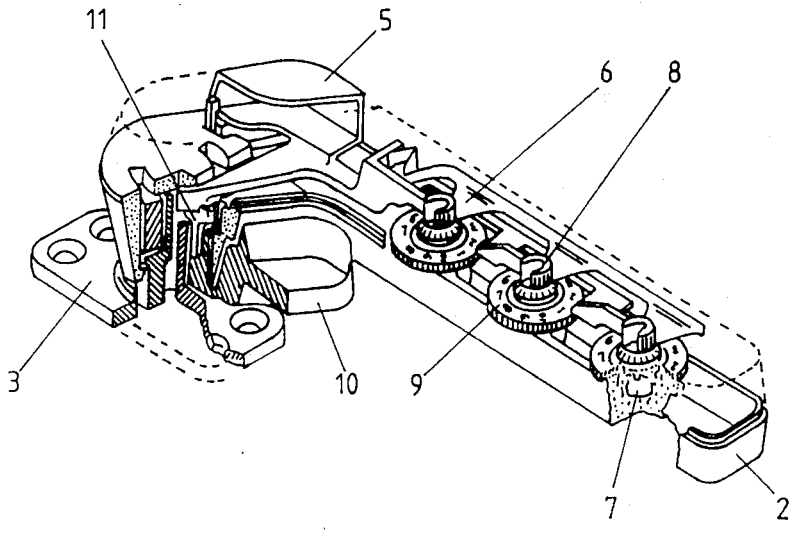
Figure 3:
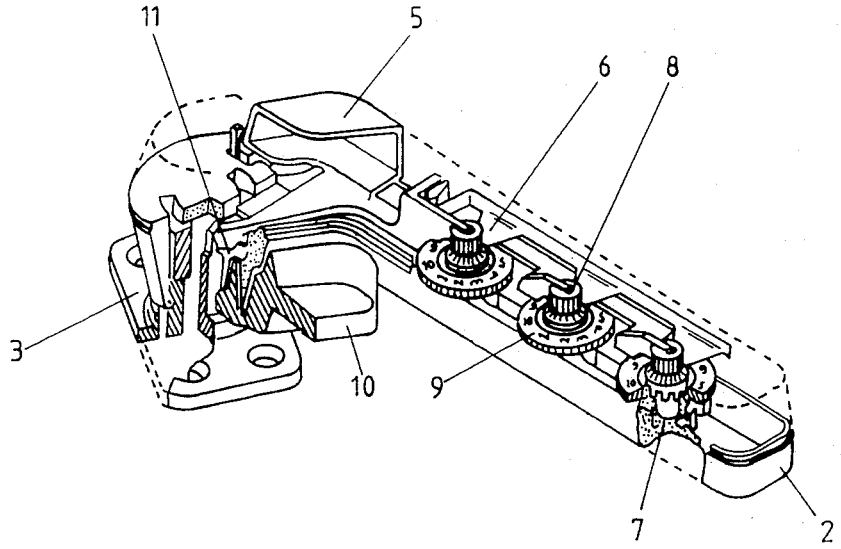

The method of operation of the lock, which is common to all versions of the lock may be seen in FIGS. 2 and 3.

The lock as shown in FIG. 2 is locked. In this position the slider (5) cannot be moved to the position shown in FIG. 3 due to the projecting tongues of the slider (5) being unable to enter the recesses in the thumbwheel inner's (8).

To unlock the lock, the slide (5) must be moved from it's position shown in FIG. 2 to it's position shown in FIG. 3. For this movement to be posible the three thumbwheel inner's (8) must be rotated so that they are aligned as shown in FIG. 3 to allow the projecting tongues of the slider (5) to enter the recesses in the thumbwheel inner's (8).

In normal use the thumbwheel inner (8) and thumbwheel outer (9) are held together by the spring (6) and rotate together as one unit. The spring (6) also acts on the Slider (5) to hold it in the locked position.

Figure 4:
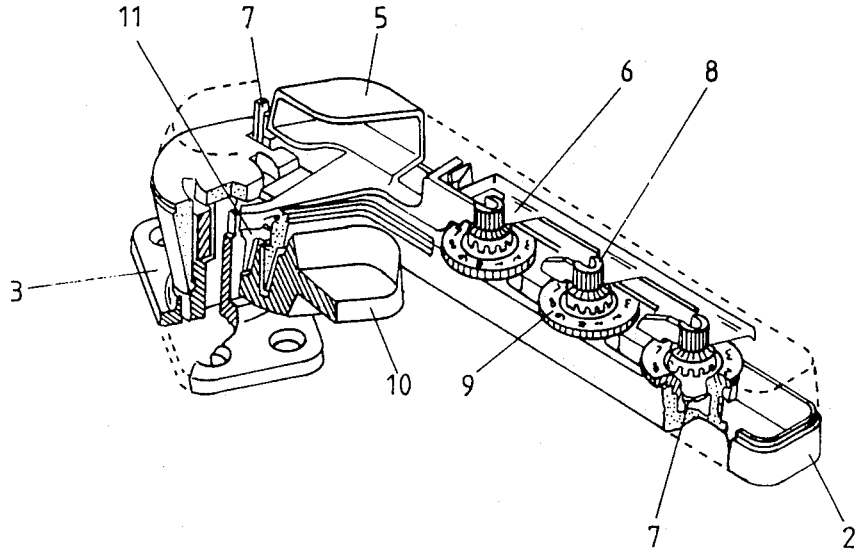

To change the combination of the lock the lock has first to be unlocked, to do this the slider (5) is moved to the position shown in FIGS. 3 and 4. When the slider (5) is in the unlocked position the end of the pivot combination change bar (7) is accessible. To change the combination, the pivot combination change bar (7) is lifted, this bar has three projecting fingers, one under each thumbwheel inner (8), the movement of these fingers lifts the splines of the thumbwheel inners (8) out of engagement with the splines of the thumbwheel outers (9). The thumbwheel outers (9) are thus free to be rotated to whatever number is required, while the thumbwheel inners (8) are retained in the unlocked position by the tongues of the slider (5) in the recesses of the thumbwheel inners (8). When the pivot combination change bar (7) is released it returns to its normal position due to action of the spring (6) bearing on the serrated shoulder of the thumbwheel inner (8). The thumbwheel inner (8) is also returned into engagement with the thumbwheel outer (9) due to the action of the Spring (6).

To prevent detection of the correct combination by feel the surface of the thumbwheel inners (8) which comes into contact with the tongues of the slider (5) is serrated so that the recess in the thumbwheel inner (8) is undetectable. The serrations are extended to the shoulder of the thumbwheel inner (8) so that the action of the spring (6) causes the rotation of the combined Thumbwheel inner (8) and outer (9) to be in discrete steps matching the numbering arrangement on the thumbwheel outer (9).

To prevent the slider (5) from being forced such that it's tongues are distorted and the locking arrangement is by-passed the visible portion of the slider (5) is attached to the main part of the slider (5) via a weak section which would shear if excessive force were to be used to try to override the lock.

The previous description of the operation of the pivoting handle lock is common to the three versions mentioned, the following description is specific to each version:

(a) U.K. Version

This version is shown in FIGS. 1 to 4, although the corresponding wedge plate (12) is only shown in outline in FIG. 1 From FIG. 2 it is seen that the catch (10) is being held locked to the Pivot base (3) by the finger plate (11) being in the recess of the Pivot base (3). In this position the catch (10) is locked, but the main part of the handle i.e. the pivot handle upper (1) and lower (2) are free to rotate, the curve portion of the slider (5) being in a slot in the finger plate (11) to allow this movement to take place. When in the locked position the free movement of the handle gives added security in that if the handle is forced passed it's normal operating position only the handle will be free to move, the catch (10) will still be locked to the Pivot base (3) by the finger plate (11).

To unlock the pivot Handle the slider (5) is moved to the position shown in FIG. 3, this in turn moves the finger plate (11) out of engagement in the recess in the pivot base (3) and into engagement with the recess in the pivot handle lower (2). The catch (10) therefore acts as a single unit with the pivot handle lower and may be unlatched from the wedge plate (shown in FIG. 1 only) by moving the pivot handle.

When this version of the pivoting handle is locked the catch plate (10) is in engagement with the wedge plate (12). When the two are in engagement with each other they are prevented from sliding apart by the provision of a lip on each component which restrains any translational movement of either the catch plate (10) or the Wedge plate (12).

This version of the pivoting handle lock also has provision for an Outer reinforcing plate (13). In use this would be located on the outside of the opening window frame and fastened to the pivot base (3) by machine screws into the blind self locking threaded holes in the protruding bosses. This outer reinforcing plate (13) would be considered desirable where the opening window frame section was considered insufficient to accept reasonable sized woodscrews.

(b) European Version

Figure 5:
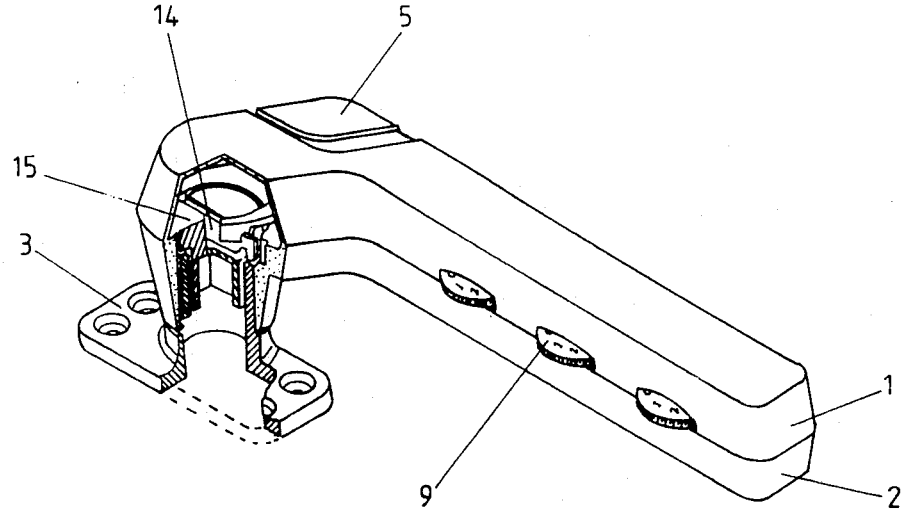

This version is shown in FIG. 5, and is designed to suit windows having internal mechanisms operated by drive shafts passing through the centre of the pivot base, in this example using a square shaft into the recessed drive member (15).

The method of operation in this version is very similar to that used in the U.K. version. The finger plate (14) locks the recessed drive member (15) to the pivot base (3). This is the position as shown in FIG. 5. As in the U.K. version the main part of the handle i.e. the pivot handle, upper (1) and lower (2) are free to rotate.

To unlock the pivot handle the slider (5) is moved, this in turn moves the finger plate (14) out of engagement with the pivot base (3) and into engagement with the pivot handle lower (2), the pivot handle and recessed drive member (15) now act as one unit and any drive shaft engaging in the lock would be rotated by rotation of the pivot handle.

(c) Door Lock Version

Figure 6:
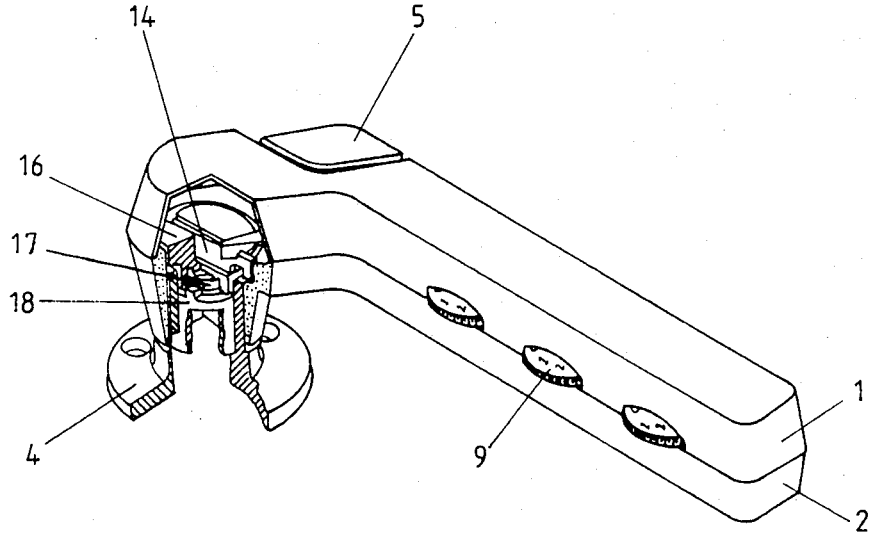

This version is shown in FIG. 6, and is designed to suit doors having internal mechanisms operated by drive shafts passing through the centre of the pivot base, in this example using a square shaft into the drive member (18).

The method of operation in this version is very similar to that used in the U.K. and European versions. The finger plate (14) locks the spigotted drive member (16) to the pivot base (4). As in the U.K. and European versions the main part of the handle i.e. the pivot handle, upper (1) and lower (2) are free to rotate.

To unlock the pivot handle the slider (5) is moved, this in turn moves the finger plate (14) out of engagement with the Pivot base (4) and into engagement with the pivot handle, lower (2). This is the arrangement as shown in FIG. 6. The pivot handle and spigotted drive member (16) now act as one unit and any rotation of the pivot Handle causes the spigotted drive shaft (16) to rotate.

As this lock is designed for use on doors, it should be a requirement that the drive shaft into the internal mechanism should be free to rotate if the handle on the opposite side of the door is operated. To allow for this the drive member (18) is free to back rotate against a spring (17) with the lost motion being taken by the spigotted drive member (16) having a member acting in an oversized recess in the drive member (18), i.e. the drive member (18) only rotates when the pivot Handle is unlocked and rotated, or when the drive shaft passing through the door is rotated from the opposite side handle.

For this version of the lock it is possible that an additional spring will be required to prevent the handle from drooping and although not shown in FIG. 6 it is feasable to fit a spring between the pivot base (4) and the pivot handle lower (2)

In FIG. 6 the pivot base (4) is shown with provision to accept countersink screws, as in the version of the lock the screws will be accessible it is proposed that either, vandal-proof screws, a clip on shield, through screws from the reverse side of the door or an extended skirt projecting from the lower part of the pivot handle, lower (2) will be provided.

METHOD OF OPERATION

Retaining Stay

The method of operation of this lock is based on the same concept as used in the pivoting handle.

Figure 7:
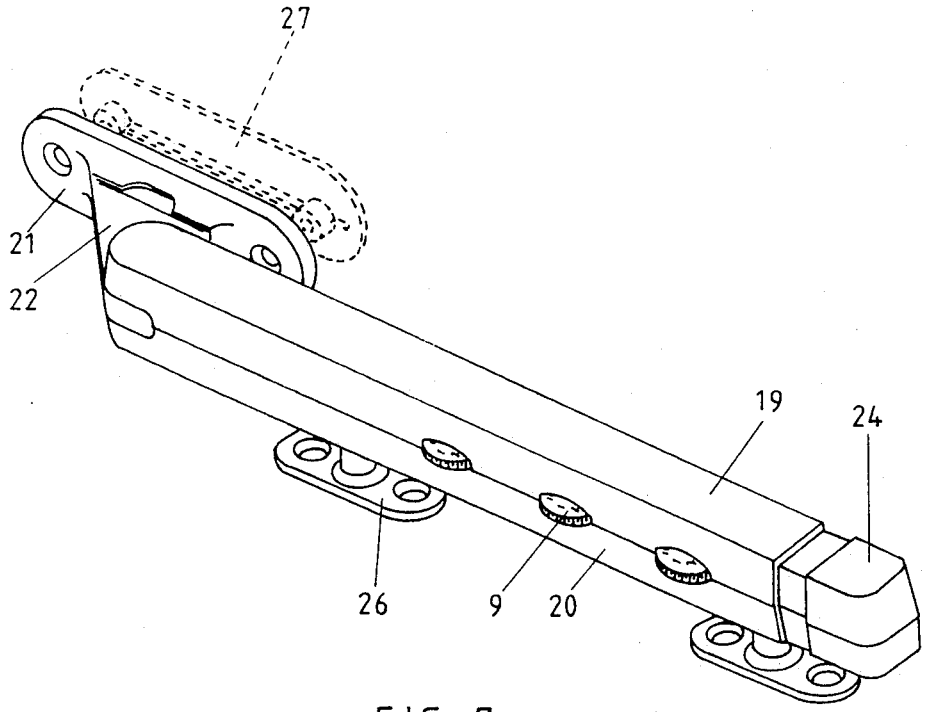
FIGS. 7 and 8 are illustrations of detailed component parts of a second embodiment of latch according to the invention in the form of a pivoting window retaining stay.
Figure 8:
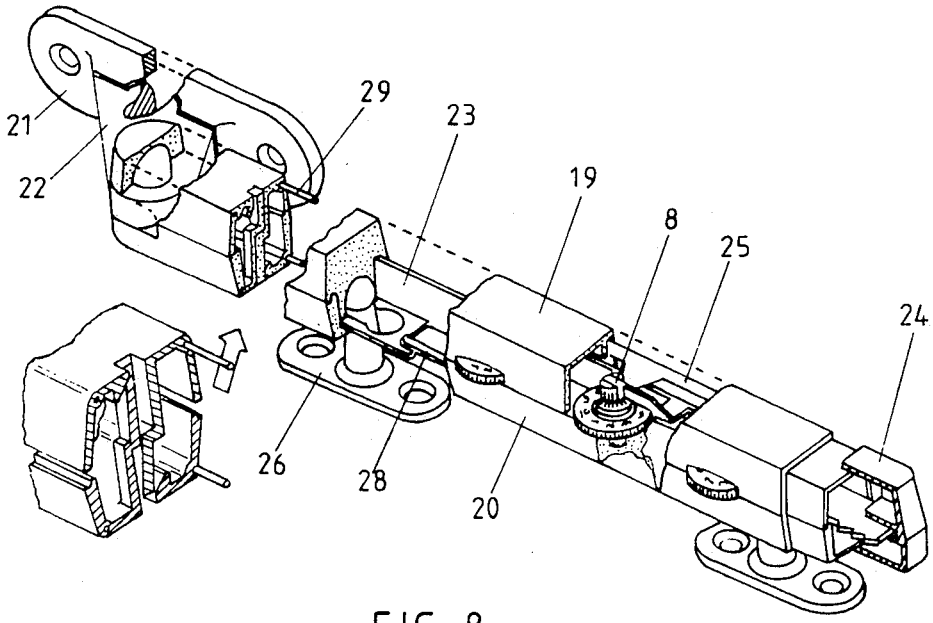

An external view of the retaining stay is shown in FIG. 7 and a part sectional view is shown in FIG. 8

In FIG. 7 an outer reinforcing plate (27) is shown, this is to be used as previously described in the U.K version of the pivoting handle lock.

FIG. 8 shows the component parts of the retaining stay lock. In operation, the Spigot (26) which has a bulbous head, is held captive by the keyhole slot in the Slider-stay (23). To lift the stay handle, upper (19) and lower (20) off the Spigot (26), the slider stay (23) must be moved towards the hinge and of the stay, against the effect of the spring (25), by pressing on the end fitting (24). Movement of the end fitting (24) and therefore the slider stay (23) is only possible when the recesses in the Thumbwheel inners (8) are aligned so that the projecting tongues of the Slider-stay (23) may enter. With the recesses in alignment the slider-stay (23) may be moved so that the enlarged portions of the keyhole slots are in alignment with the recesses in the retaining stay. In this position the Retaining stay may be lifted off the Spigots (26), the window opened to a different position and the retaining stay relocked onto a Spigot (26).

The method of changing the combination of the lock is changed from that used in the pivoting handle in one way only, i.e. in the retaining stay, the Stay combination change bar (28) is actuated via a small hole on the underside of the Stay handle, lower (20). The stay combination change bar (28) is only accessible through the hole when the retaining stay is unlocked, and the Slider-stay has been moved towards the hinge end of the retaining stay FIG. 8 also shows the anti-sawing rods (29) inserted in suitable longitudinal recesses in the lock bodies, to provide resistance to attack e.g. hacksaw etc.

A similar arrangement may be adapted to protect the remaining areas of the lock, i.e. a central rod fitted inside the Spigot (26), etc.

It is anticipated that the above would only be offered on a special high security version of the locks.

Also shown in FIG. 8 is a method of joining the stay handle, upper (19) to the stay handle, lower (20) without the use of screws or rivets.

Each of the projections shown can be formed during the casting process, without the need for additional movable cores in the mould.

During the assembly process the upper (19) and lower (20) halves of the body are brought together, and during this the projections interfere with each other.

With a moderate amount of force applied to close the upper (19) and lower (20) halves, the projections deflect, this deflection increases as the two halves of the lock are brought closer together, until the two steps on the projections overlap each other and the projections approximately return to their original shape.

The upper (19) and the lower (20) halves of the body are now locked together, with the only way to gain access to the inside of the bodies being by destruction of the lock i.e. there are no rivets or screws to form a weak point in the local body.

I claim:

1. A latch of the type specified for mounting on a movable frame of an openable door or window and which is co-operable with a corresponding keeper on or in a surrounding fixed frame, in which the latch comprises a latching element which is movable into latching engagement with the keeper when the movable frame is in a closed position with respect to the surrounding fixed frame, an elongate arm coupled with the latching element, a slide actuator mounted on the elongate arm and including at least two tongues spaced apart along the longitudinal axis of the actuator, and at least two combination wheels mounted on the elongate arm, said wheels being spaced apart along the longitudinal axis of the elongate arm such that each wheel is located adjacent an edge of a tongue and including a radially extending slot, the position of which is determined by the combination set on the wheel, the actuator being moveable longitudinally of the arm when a correct combination has been set on both of the combination wheels, from a locked position in which the latching element is locked with respect to the keeper and an unlocked position in which the tongues enter the recesses in the wheels to allow release of the latching element, and spring means acting on the actuator to urge the actuator into the locked position.

2. A latch according to claim 1, in which the elongate arm comprises an actuator handle (1,2) of a pivoting a handle type window or door latch.

3. A latch according to claim 1, in which the elongate arm (19, 20) forms part of a pivoting stay type of window latch.

4. A latch according to claim 1, in which the combination wheels (9) are mounted substantially mid-way throughout the depth of the elongate arm (1, 2; 19, 20) and a portion of the periphery of each wheel projects laterally to one side of the arm to be available for manual manipulation.

5. A latch according to claim 1, including a slide acutator (5, 24) mounted on the elongate arm (1, 2; 19, 20) and movable longitudinally of the arm, when a correct combination has been set on the combination wheels (9), to effect release of the latching element.

6. A latch according to claim 1, comprising a pivoting handle type door or window latch.

7. A latch according to claim 1, comprising a pivoting stay type window latch.

8. A latch according to claim 7, including anti-sawing rods (29) extending internally of and along the length of the elongate arms (19, 20).

9. A latch according to claim 1, including a combination change bar (7, 28) arranged in the elongate arm an operable to lift the combination wheels (9) and thereby permit free rotation of the wheels to a required new combination setting, and then to lower the wheels into position with their new setting.

* * * * *

UNITED STATES PATENT AND TRADEMARK OFFICE

CERTIFICATE OF CORRECTION

PATENT NO. : 4,972,691

DATED : November 27, 1990

INVENTOR(S) : Robert W. Knight

It is certified that error appears in the above-identified patent and that said Letters Patent is hereby corrected as shown below:

On the title page, in item [57] ABSTRACT, line 1, delete "winder" and insert --window--.

column 2, line 24 please delete "this" and insert --This--.

column 2, line 26 please delete "C/" and insert --c/--.

column 2, line 31, insert --a-- after the word "follow".

column 2, line 35 delete "these" and insert --These--.

column 2, line 67 & 68 please delete "General Advantages (cont.)--.

column 3, line 43 please delete "slide" and insert --slider--.

column 3, line 44 please delete "it's" and insert --its--.

column 3, line 44 please delete "it's" and insert --its--.

column 3, line 45 plesae delete "posible" and insert --possible--.

column 4, line 17 please delete "it's" and insert --its--.

column 4, line 31 insert a --.-- after "Fig. 1".

column 4, line 31 start a new paragraph at the word "From".

column 4, line 36 please delete "curve" and insert --curved--.

column 4, line 40 please delete "passed it's" and insert --past its--.

column 4, line 49 please delete "lower" after the word "handle".

column 5, line 58 & 59 delete "feasable" and insert --feasible--.

column 5, line 62 delete "the" and insert --this--.

UNITED STATES PATENT AND TRADEMARK OFFICE

CERTIFICATE OF CORRECTION

PATENT NO. : 4,972,691

DATED : November 27, 1990

INVENTOR(S) : Robert W. Knight

It is certified that error appears in the above-identified patent and that said Letters Patent is hereby corrected as shown below:

column 8, line 11 delete "acutator" and insert --actuator--.

Signed and Sealed this

Eleventh Day of August, 1992

*Attest:*

DOUGLAS B. COMER

*Attesting Officer*

*Acting Commissioner of Patents and Trademarks*